US006789454B2

(12) United States Patent
Smith

(10) Patent No.: US 6,789,454 B2
(45) Date of Patent: Sep. 14, 2004

(54) GUN BARREL FOR LAUNCHING LARGE PROJECTILES

(75) Inventor: Rixford Smith, Calgary (CA)

(73) Assignee: Rescue Academy Inc., Calgary (CA)

( * ) Notice: Subject to any disclaimer, the term of this patent is extended or adjusted under 35 U.S.C. 154(b) by 0 days.

(21) Appl. No.: 10/270,735

(22) Filed: Oct. 16, 2002

(65) Prior Publication Data

US 2004/0074381 A1 Apr. 22, 2004

(51) Int. Cl.[7] ..... F41A 21/02
(52) U.S. Cl. ..... 89/16; 42/76.02
(58) Field of Search ..... 89/15, 16; 42/76.02, 42/78

(56) References Cited

U.S. PATENT DOCUMENTS

| | | | | | |
|---|---|---|---|---|---|
| 175,862 | A | * | 4/1876 | King | 42/78 |
| 475,071 | A | * | 5/1892 | Willson | 89/16 |
| 930,927 | A | * | 8/1909 | Berkstresser | 228/132 |
| 2,845,741 | A | * | 8/1958 | Day | 42/76.01 |
| 2,935,913 | A | * | 5/1960 | Wilson | 89/16 |
| 4,344,592 | A | | 8/1982 | Constantinescu | |
| 4,685,236 | A | * | 8/1987 | May | 42/76.02 |
| 5,196,650 | A | | 3/1993 | Cytron | |
| 5,217,188 | A | | 6/1993 | Thole et al. | |
| 5,600,912 | A | * | 2/1997 | Smith | 42/76.01 |
| 5,792,981 | A | | 8/1998 | Singer et al. | |
| 5,915,937 | A | * | 6/1999 | Christensen | 42/76.02 |
| 6,094,906 | A | | 8/2000 | Singer et al. | |
| 6,142,055 | A | | 11/2000 | Bogwarth et al. | |
| 6,260,797 | B1 | | 7/2001 | Palmer | |
| 6,340,498 | B2 | | 1/2002 | Kirby et al. | |

FOREIGN PATENT DOCUMENTS

| | | | | |
|---|---|---|---|---|
| EP | 0033770 | * | 8/1981 | 89/16 |

OTHER PUBLICATIONS

Handbook of Physics; Condon and Odishaw; pp. 3–10–3–12; 1958.*
www.astronautix.com, Martlet 4; pp. 1–8; Jul. 30, 2002.
Pennsylvania Machine Works: Materials Penn Machine, Materials (1 page); Jul. 30, 2002.
High Performance Cement High Performance Cement for High Strength and Extreme Durability. Konstantin Sobolev; pp. 1–4; Jul. 30, 2002.
About Metals Glossary by metalinfo .com; pp. 1–3; Jul. 30, 2002.
Space Guns, Space : Space Guns Vectors for May 1998, Greg Goebel.; pp. 1–5.
[3.0] Space Guns vl.0.0/3 of 6/01 Mar02/ gvgoebel@earlink.net /public domain pp. 1–13; Jul. 28, 2002.
Gun Launch for Orbital Vehicles, Dr. Bruce P. Dunn Original Commentary posted in sci. space newsgroups 1998 Revised 2001 ; pp. 1–4.
Rocket History , Brief History of Rockets pp. 1–5; Jul. 26, 2002.
How Satellites Work : Teacher Resource How Satellites Work : pp. 1–13; Jul. 26, 2002.
Basics of Space Flight Section III. Space Flight Operations Basics of Space Flight Chapter 14. Launch Phase pp. 1–8; Jul. 26, 2002.
SciFiWS article : What goes up stays up: Satellite basics for Sci–Fi writers What goes up stays up: Satellite basics for Sci–Fi pp. 1–8 Writers by Michael Jackman , Apr. 22, 2001.
Features Item : High Volume Flyash : A Concrete Solution Environmental Design + Construction pp. 1–6; Oct. 7, 2002 High Volume Flyash: A Concrete Solution by Scott Shell.

* cited by examiner

*Primary Examiner*—Stephen M. Johnson
(74) *Attorney, Agent, or Firm*—Bennett Jones LLP

(57) ABSTRACT

This invention discloses a gun barrel that can be used to fire large projectiles beyond the lower atmosphere, and in particular, that can be used to assist with the launching of satellites into orbit. The gun barrel has an outer support layer, an inner support layer lining the bore of the gun barrel and a compressible material disposed between the outer support layer and inner support layer. The support layers are preferably steel, and the compressible material is preferably concrete. In one embodiment, the breech portion is made of a metal such as steel, and the remainder of the gun barrel is made of an inner support layer an outer support layer and a layer of compressible material therebetween. The gun barrel of this invention is less expensive to make and lighter than a similarly-sized gun barrel made of steel, while being sufficiently strong to launch large projectiles.

30 Claims, 6 Drawing Sheets

GUN BARREL FOR LAUNCHING LARGE PROJECTILES

FIELD OF THE INVENTION

The present invention relates to the field of gun barrels for the launching of large projectiles and in particular to the field of gun barrels to be used to assist with the launching of satellites into low earth orbit.

BACKGROUND OF THE INVENTION

It has long been thought possible to use large guns to assist with the launching of devices into orbit. One means of potentially accomplishing this is to use a very large gun barrel to launch a projectile, such as a rocket with a satellite payload, beyond the lower atmosphere of the earth, and then to fire the rocket so that it will cause the satellite to reach orbital velocity and subsequently enter into an orbital path. The rocket is launched to a height that is above the lower atmosphere, as it is in the lower atmosphere that most drag occurs and where most rockets use up a large quantity of their fuel. By firing the rocket in the near vacuum of the upper atmosphere, less fuel is required by the rocket to achieve orbital velocity. Since a gun barrel can be used more than once, gun launching provides an economical first stage for launching satellites. Additionally, a gun launch can be used in almost any weather condition.

Long-range artillery capable of launching projectiles a significant distance was first developed and used in WW I. For example, the Paris gun, when fired at an angle of 50 degrees, was able to send a projectile to an altitude of 43.2 km, well past the 12 km that is generally considered to be the "lower atmosphere". The Max E gun could fire a 740 kg projectile to a maximum range of 47 km. The Paris Gun and the Max E, if fired at a 90-degree angle to the earth's surface could have fired projectiles past the lower atmosphere. The 800 mm Gustav developed in WW II could fire a 4800 kg shell a distance of 47 km, and a 7100 kg shell a distance of 38 km.

In the early 1960's, Gerald Bull was involved with a project called HARP, an acronym for High Altitude Research Project, which program involved the use of large guns to fire projectiles and rockets to high altitudes. The HARP program was cancelled before its goal of achieving orbital entry of a device was obtained, because the system was too expensive and the available technology would not support further research. However, altitudes of 110 miles were reached, with 400-pound projectiles.

Advances in the development of rockets, new types of rocket fuels, new propellants for artillery, and advances in the design of smaller satellites, such as nano and pico satellites, which can weigh as little at 10 ounces, now make the gun-assisted launching of orbital devices, such as satellites, possible.

One component of a gun launch apparatus for the launching of a large projectile is the gun barrel. To be able to assist in achieving orbital launching of a device, the gun barrel must be very large. Traditionally, very large gun barrels have been comprised of steel, to provide the required strength and rigidity. However, steel gun barrels of the size required for gun-assisted orbital launching are expensive to make and heavy. The weight of a large steel gun barrel is a factor that significantly interferes with the ability to move or vary the location of the gun barrel, and the latter problem limits the potential to use the same gun barrel to repeatedly launch satellites into orbit, as the barrel is always pointed to the same position.

The cost of putting a satellite into orbit is currently very high. Advances in rocket and satellite technology suggest that it is worthwhile to revisit the concept of using large guns to assist with the launching of satellites into orbit, particularly if it will lower the cost of satellite launching. One way to lower the cost is to make a gun barrel that is less expensive than a steel gun barrel.

SUMMARY OF THE INVENTION

In accordance with the above objectives, there is disclosed herein a gun barrel and for use with the launching of large projectiles, and in particular to the launching of rockets with satellite payloads. The gun barrel is less expensive to manufacture than a steel gun barrel, possibly less heavy than steel and sufficiently strong for the purposes mentioned herein, namely for the firing large projectiles. The gun barrel of this invention may also be used to launch large projectiles, such as artillery, or devices that can be used to intercept nuclear weapons.

In one embodiment, the invention is a gun barrel, with (a) a breech end and an open end;

(b) a bore disposed between the breech end and the open end, (c) an outer support layer on an outside surface of the gun barrel;

(d) an inner support layer lining the bore of the gun barrel, and (e) a layer compressible material disposed between the outer support layer and inner support layer, said compressible material having a compressive strength of at least 10 mPa and having a compressive strength that is less than the than the compressive strength of one of (a) the inner support layer and (b) the outer support layer.

The breech end may be closed, or closeable, for example by use of a breech plug.

The outer support layer and the inner support layer can be comprised of a metal, such as steel. The compressible material can be concrete. Alternatively, it may be another type of compressible material with a compressive strength of greater than 10 mPa, for example a plastic material. The layer of compressible material can be reinforced.

In one embodiment, the gun barrel comprises an outer layer of steel on the outside surface of the gun barrel, an inner layer of steel lining the bore of the gun barrel, and a layer of concrete disposed between the outer layer of steel and the inner layer of steel, said concrete having a compressive strength of at least 10 mPa. The gun barrel may have a breech end that is one of either (a) closed or (b) closeable, and the second end the bore is open.

In another embodiment, the invention is a gun barrel with a breech end and an open end and a bore disposed between the breech end the open end, comprising:

(a) a breech portion made of metal, and (b) an elongate portion adjacent to the breech portion, said elongate portion further comprising:

(i) an outer support layer on an outside surface;

(ii) an inner support layer lining the bore of the gun barrel, and (iii) a layer compressible material disposed between the outer support layer and inner support layer, said compressible material having a compressive strength of at least 10 mPa and having a compressive strength that is less than the than the compressive strength of one of (a) the inner support layer or (b) the outer support layer.

The breech end may be closed or closeable, for example with a breech plug.

DETAILED DESCRIPTION OF PREFERRED EMBODIMENTS

Figure 1:
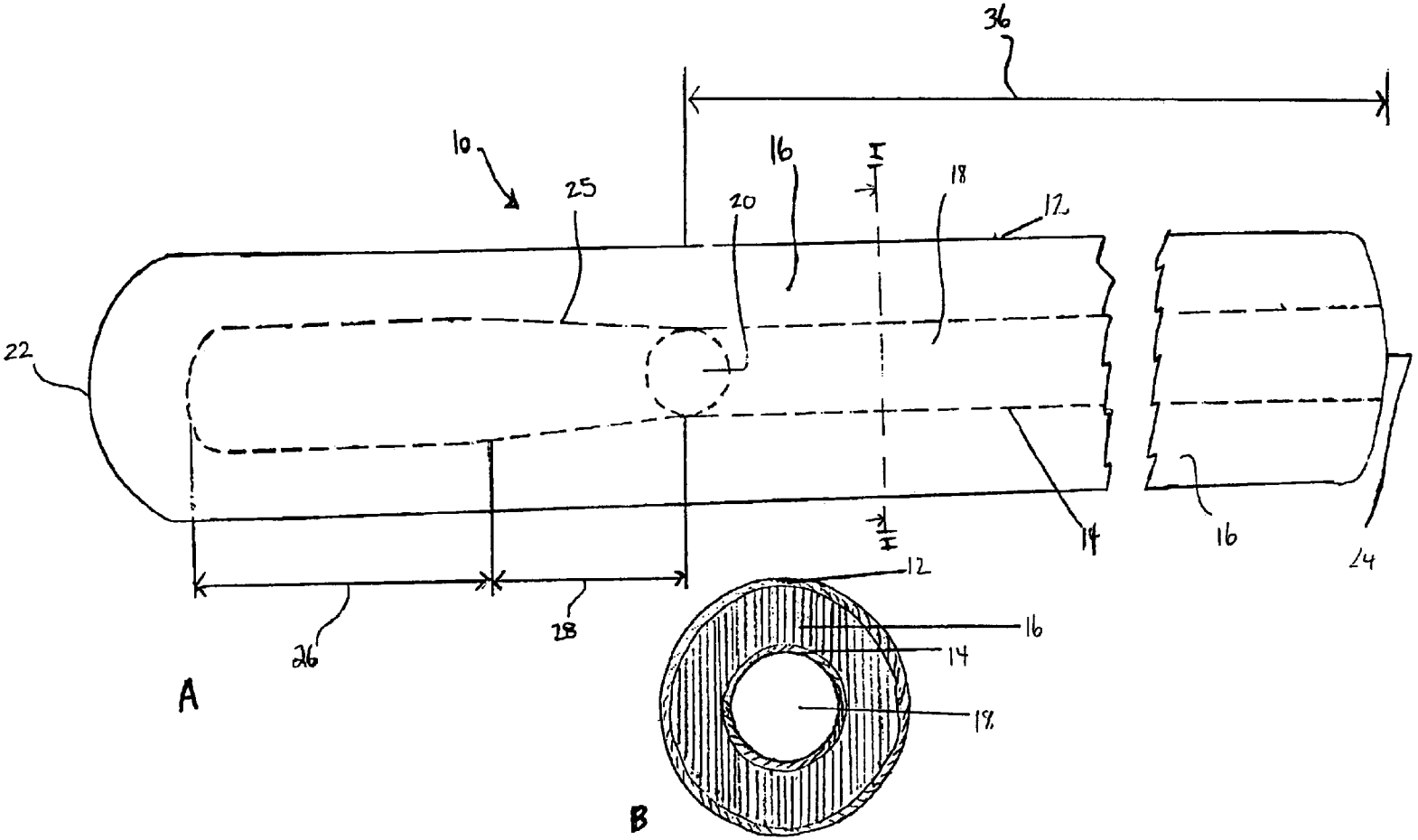
FIG. 1(A) is an elevational view of an embodiment of the gun barrel of this invention, with the inside parts shown by dashed lines.
FIG. 1(B) is a cross section taken along line I—I of FIG. 1(A).

Reference will now be made to FIGS. 1–5, which show different embodiments of the invention disclosed herein. FIG. 1 shows an embodiment of the gun barrel 10 of this invention, which includes an outer support layer 12, an inner support layer 14, and disposed therebetween, a layer of compressible material 16. The inner support layer 14 defines a bore 18, along which a projectile 20 will travel, from a breech end 22 to a muzzle end 24.

Although referred to herein as a gun barrel, the gun barrel of this invention may alternatively be referred to as a launching tube, a cannon, or the like. The gun barrel 10 of this invention is used to launch large projectiles, and therefore must itself be large. "Large" as used herein means a gun barrel that has a length of greater than about 35 meters, and a diameter of the bore 18 that is greater than about 100 mm.

Layers 12 and 14 are referred throughout herein as support layers. As used herein a "support layer" is a layer that is, among other things, able to substantially resist cracking and deformation following firing of a projectile from the gun barrel and able to be used for repeated firing of a projectile from the gun barrel. The support layers substantially prolong the useable life of the gun barrel.

The support layers may be made of a metal, which as used herein includes alloys. Steel, including high-carbon steel is a metal that may be used in layers 12 and 14 of the gun barrel 10. Other metals, such as titanium, may also be used. Any non-metal material now known or hereafter developed, that would be capable of functioning as a support layer, is intended to be included herein. As is apparent, outer support layer 12 and inner support layer 14 may be comprised materials that are different from one another.

The outer support layer 12 functions, in particular, to provide tensile strength to the gun barrel both during the recoil and while the projectile travels up the barrel. The outer support layer 12 confines the layer of compressible material 16 during the firing of the projectile, should the layer of compressible material crack or otherwise fall apart. Ideally, the outer support layer will remain intact through repeated uses of the gun barrel.

In one embodiment, shown in FIG. 1, the outer support layer is comprised of steel. Although many different grades or thicknesses of steel may be used, preferred is 12.5 mm thick, A105 forged carbon steel.

Figure 4:
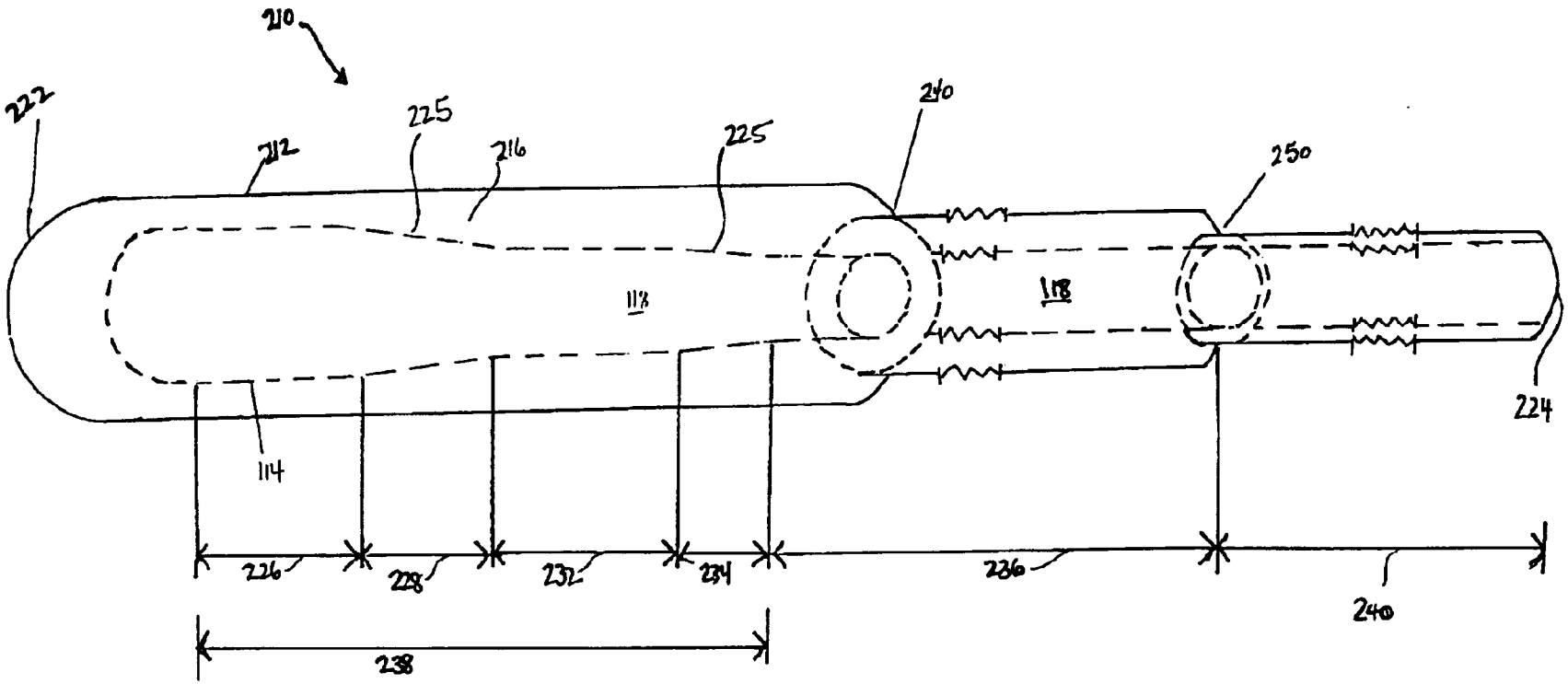
FIG. 4 is an elevational view of an embodiment of the gun barrel of this invention, with the inside parts shown by dashed lines.
Figure 5:
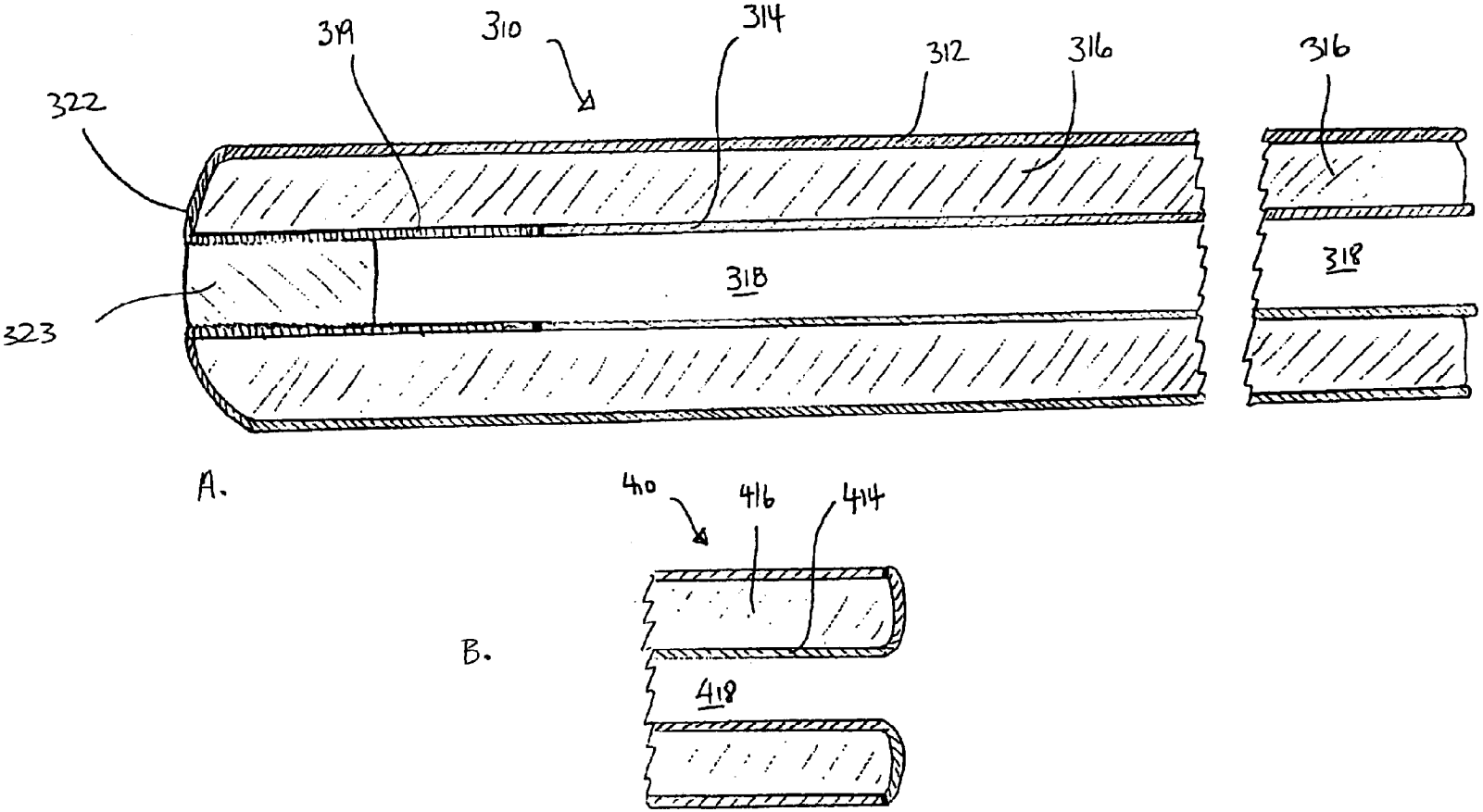
FIG. 5A is a longitudinal cross-sectional view of an embodiment of the gun barrel of this invention.
FIG. 5B is a longitudinal cross-sectional view of the muzzle end of an alternative embodiment of this gun barrel of this invention.

The outer diameter of the gun barrel may be constant from breech end 22 to muzzle end 24, as shown in the embodiments shown in FIGS. 1 and 5. Alternatively, the outer diameter of the gun barrel may decrease, progressing from breech end to muzzle end, as shown in the embodiments shown in FIGS. 3 and 4.

The inner support layer 14 lines bore 18. The inner support layer 14 functions, in particular, to provide a lining for the bore 18 which will enable a projectile to be fired from the gun barrel of this invention, and also to physically separate the projectile from the layer of compressible material 16. Ideally, the inner support layer will remain intact through repeated use of the gun barrel. The material from which the inner support layer is made will depend largely upon the amount and type of propellant used in the gun barrel.

In one embodiment of this invention, the inner support layer 14 in a portion of the bore 18 that is closer to, or at, the breech end, is made of a material that is particularly resistant to the explosive forces generated upon firing of the projectile 20 from the gun barrel 10. For example, hardened steel or titanium may be used in this portion of the gun barrel. These metals are more resistant to damage caused by launching of projectiles than are other metals, and therefore their use will increase the useable life of the gun barrel. Although the portion of bore 18 that is covered by this more resistant material may vary, generally it is sufficient that the more resistant material extend about 20% up the length of the bore 18 from the breech end. A gun barrel 310 with a portion 319 of the bore 318 made of a particularly resistant material, is shown in FIG. 5A.

In one embodiment, shown in FIG. 1, the inner support layer is comprised of steel. Many different types of steel may be used, and the type of steel used will in large part depend upon the propellant used. Preferred is 12.5 mm thick, A105 steel, however other thicknesses or grades of steel may be used.

The outer and inner support layers may vary a great deal in thickness, as between different embodiments of the gun barrel. The thickness of either of these layers will depend upon the thickness of the other layers of the gun barrel. For example, if the inner support layer, or layer of compressible material, or both, are particularly thick, the outer support layer may be thinner than in a similarly-sized gun barrel where the inner support layer, or layer of compressible material, or both, are less thick. What is important is that each layer is capable of performing the function required of it, and that all three layers combined create a gun barrel that is strong enough to be fired repeatedly.

At the muzzle end 24 of the gun barrel 10, the inner support layer 14 and the outer support layer 12 may meet or overlap, in order to enclose the compressible material. This embodiment is shown in FIG. 5B, where the inner support layer 414 extends around the end of the gun barrel 410, to completely cover the layer of compressible material 416. Alternatively, the compressible material may remain exposed, as is shown in FIG. 5A, where the layer of compressible material 316 is exposed at the muzzle end of the gun barrel 310.

Figure 3:
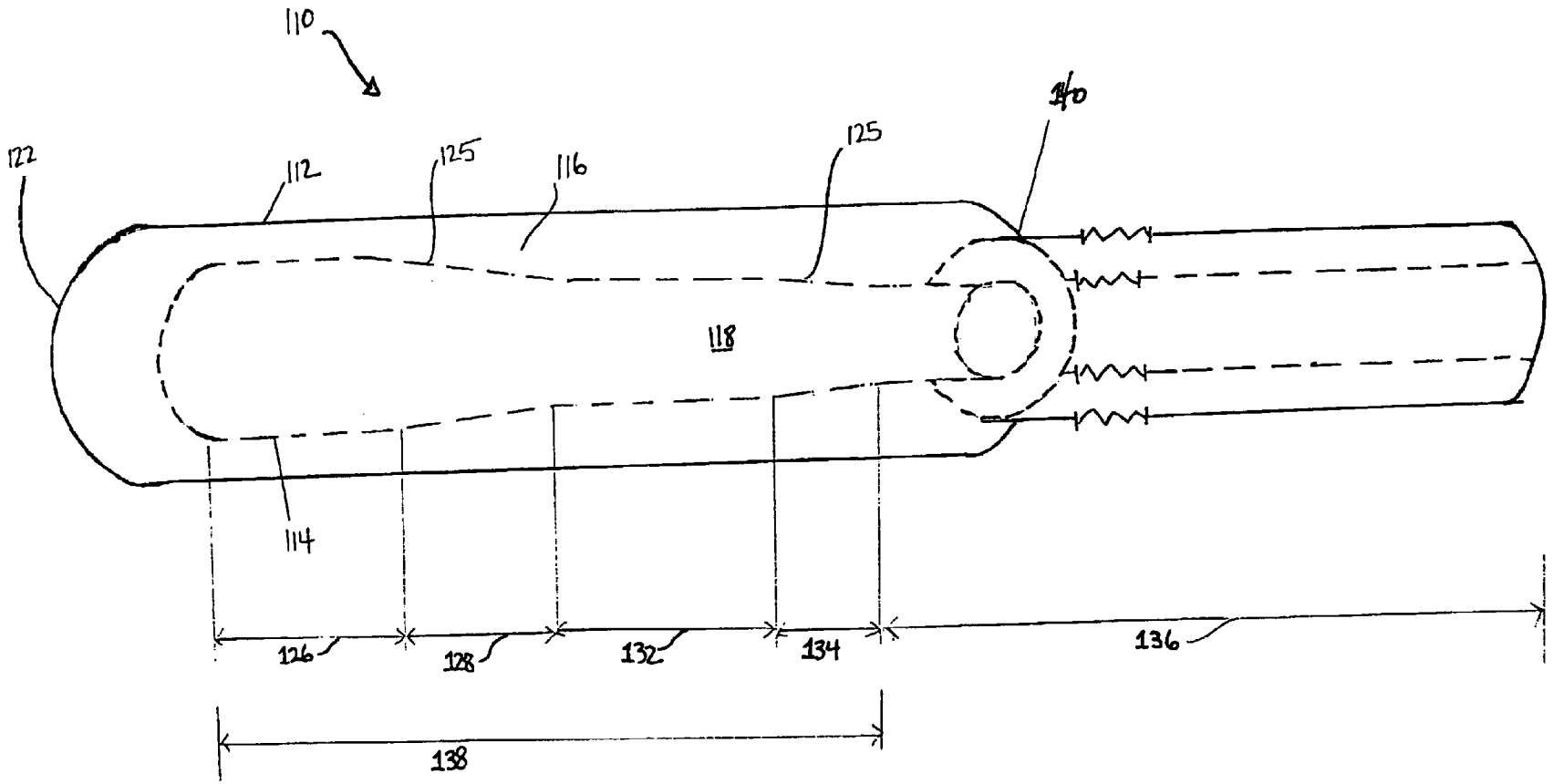
FIG. 3 is an elevational view of an embodiment of the gun barrel of this invention, with the inside parts shown by dashed lines.

The breech end 22 of the gun barrel 10 may be closed. A gun barrel made in this way would therefore be loaded with propellant and the projectile from the muzzle end. This embodiment is shown in FIGS. 1, 3 and 4. For a gun barrel with a closed breech end, the layer of compressible material is preferably thicker at the breech end than elsewhere in the gun barrel.

Alternatively, the gun barrel may be designed to be loaded from the breech end. If the gun barrel is to be loaded from the breech end, the breech end of bore 18 will be open and will need to be closed prior to firing a projectile. In this embodiment, an example of which is shown in FIG. 5A, a breech plug 323 may be threaded into the bore 318 before firing of the projectile. The size of the breech plug will vary, however for a large gun the breech plug would likely be upwards of one meter in length, and preferably about 3 meters long. The compressible material may be enclosed by one or both of the inner and outer support layers, or it may be exposed.

The diameter of bore 18 may be constant or variable along its length. FIG. 1 shows embodiment where the inner diameter of bore 18 is variable, comprising a wider-diameter section closer to the breech end 22, a narrower-diameter section closer to the muzzle end 24, and a transition region 25, the extent of which is represented by arrow 28. The extent of the wider-diameter section is represented by arrow 26 and the extent of the narrower-diameter section is represented by arrow 36. FIG. 5A shows an embodiment 310 of this invention with an inner support layer 314, an outer support layer 312, a layer of compressible material 316, and a bore 318 that is of constant diameter along its entire length. A gun barrel with a constant inner bore diameter may be used, however it is not as efficient as one in which the diameter reduces as one progresses from breech to muzzle. In particular, it requires more propellant than a similarly sized gun barrel with a bore 18 of decreasing diameter. A decrease in bore 18 diameter proceeding from breech to muzzle serves to focus the propulsive forces and thereby eject the projectile at a greater speed than with a constant diameter bore of the same length. FIGS. 3 and 4 shown embodiments in which the diameter of bore 18 is reduced more than once.

The gun barrel 10 of this invention may comprise a bore 18 that is smooth, meaning that it does not have any grooves or ridges, known as rifling, that would assist in stabilization of the projectile fired therefrom. Smooth-bored gun barrels are preferred in the gun barrel 10 of this invention, as they are less expensive to make and because in a smooth-bored gun barrel the projectile is under less force, and therefore the barrel itself is under less stress than a gun barrel with a rifled bore. Therefore, a smooth-bored gun barrel has a longer usable life. However, alternative embodiments of the invention would include bores 18 in which there is rifling. A projectile can be more accurately launched through a rifled bore than a smooth bore. Therefore, a rifled bore may be preferred for applications where accuracy is important. However, the use of a fin-stabilized projectile in a smooth bored gun barrel 10 would likely provide sufficient accuracy for most purposes associated with satellite launching.

The compressible material used in the gun barrel of this invention is a material that has a compressive strength that is sufficiently high to enable the layer of material to substantially withstand the compressive load that it will be subjected to during the firing of a projectile from a gun barrel. "Compressive strength" as used herein means the ability of a material to withstand compressive (squeezing) loads without being crushed when the material is in compression. The compressible material will additionally have a compressive strength that is less than the compressive strength of either or both of the inner support layer and outer support layer of the gun barrel in which it is used.

A preferred compressible material 16 is concrete. "Concrete" as used herein means an aggregation of minerals, such as sand, that has been coalesced into a solid mass with cement and water. "Cement" as used herein refers to the binding material in concrete. Concrete with a compressive strength above 10 mPa may be used and concrete with a compressive strength of about 80 mPa is preferred.

Other compressible materials that have a compressive strength of about at least 10 mPa would be useful in the gun barrel of this invention. Of particular use may be plastics, or other synthetic materials that have a compressive strength that is as high or higher than concrete, but which would be significantly lighter than concrete.

The thickness of the layer of the compressible material 16 will vary, depending upon the other features of the gun barrel 10. For example, if thicker support layers 12 and 14 are used, the layer of compressible material may be thinner than in a gun barrel of the same dimensions but with thinner support layers 12 and 14.

The use of concrete in the gun barrel 10 that has the inner and outer support layers 12 and 14 made of steel, reduces the weight and cost of the gun barrel as compared to a steel gun barrel of the same dimensions, while providing a gun barrel that is sufficiently strong for firing large projectiles. Other inexpensive compressible materials as defined herein, used in the gun barrel 10 that has the inner and outer support layers 12 and 14 made of steel, would also be useful to make a lighter and less expensive gun barrel than one made entirely out of steel, but which would be sufficiently strong for the firing of large projectiles.

Figure 2:
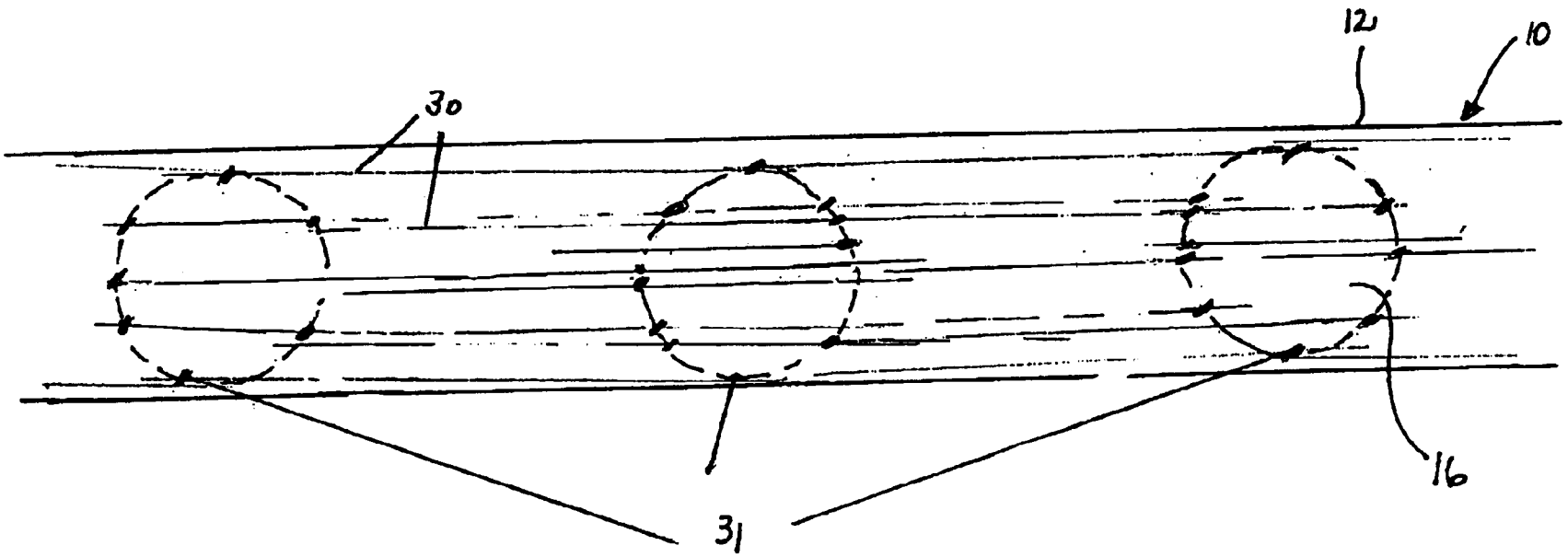
FIG. 2 is an elevational view of a portion of an embodiment of the gun barrel of this invention, showing reinforcement of the layer of compressible material.

The layer of compressible material in any of the embodiments disclosed herein may be reinforced by a reinforcing element 30. The reinforcing element 30 functions to increase the strength and stability of the compressible material 16, and thereby reduce or eliminate the possibility that the layer of material will crack, or otherwise break up when the projectile 20 is fired from the gun barrel 10. In the embodiment shown in FIG. 2, the reinforcing element 30 is comprised of a steel concrete reinforcing bar known as rebar and the compressible material is concrete. The size and type of rebar used, including diameter and length, will vary according to the dimensions of the gun barrel. As can be seen in FIG. 2, the rebar is positioned longitudinally, with respect to the longitudinal axis of the gun barrel 10, within compressible material 16, and held in place with the assistance of wire, 31. Wire mesh is another common reinforcing element 30, used in concrete. Additionally, chemicals that strengthen concrete, such as flyash, may be used as a reinforcing element. When concrete is used, reinforcement with rebar or wire mesh is preferred in most circumstances.

FIG. 3 shows an embodiment 110 of this invention, which comprises an outer support layer 112, an inner support layer 114, and disposed there between, a layer of compressible material 116. Layers 112, 114 and 116 have the same characteristics as described above for layers 12, 14 and 16. The inner support layer 114 defines a bore 118 along which a projectile will travel, from a breech end 122 to a muzzle end 124. Bore 118 decreases in diameter from breech end 122 to muzzle end 124, having two transition regions 125, the length of which are represented by arrows 128 and 134. Therefore, bore 118 comprises three sections of different diameter, referred to herein as the wide-, mid- and narrow-diameter bore regions, with a length as represented by arrows 126, 132 and 136. The transition regions connect the various sections of the bore. Preferably the transition regions will be angled at about 2–20 degrees from the longitudinal axis of the bore, however the angle may be greater or less, provided that it does not adversely interfere with the movement of the projectile along the bore 118.

Unlike the embodiment shown in FIG. 1, the outer diameter of the gun barrel 110 decreases at a point 140 along the length of the gun barrel 110.

The thickness of the layer of compressible material 116 varies along the length of the gun barrel 110. In region 138 of FIG. 3, the outer diameter of the gun barrel is constant, whereas the diameter of bore 118 varies. Therefore, the thickness of the layer of compressible material 116 will vary accordingly. After the transition at point 140 from a wider to a narrower outer diameter, while the diameter of the bore remains constant, the thickness of the layer of compressible material 116 will again change.

FIG. 4 shows an alternative embodiment 210 of this invention, which comprises an outer support layer 212, an inner support layer 214, and disposed therebetween, a layer of compressible material 216. Layers 212, 214 and 216 have the same characteristics as described above for layers 12, 14 and 16. The inner support layer 214 defines a bore 218, along which a projectile will travel from a breech end 222 to a muzzle end 224. Bore 218 decreases in diameter from breech end 222 to muzzle end 224, having two transition regions 225 the length of which are represented by arrows 228 and 234, which result in a bore that comprises three sections of different diameter. These three sections are referred to herein as the wide-, mid- and narrow-diameter bore regions, the length of which are represented by arrows 226, 232 and 236, respectively. The transition regions connect the various sections of the bore.

Unlike the embodiment shown in FIG. 3, the outer diameter of the gun barrel 210 decreases at a point 240 along the length of the gun barrel 210, and again at point 250 along the length of gun barrel 210.

The thickness of the layer of compressible material 216 varies in the embodiment shown in FIG. 4, to a greater extent than in the embodiment shown in FIG. 3. In region 238 of FIG. 4, the outer diameter of the gun barrel is constant, whereas the diameter of bore 218 varies. Therefore, the thickness of the layer of compressible material 216 will vary accordingly. After the transition, at point 240 from a wider to a narrower outer diameter, while the diameter of the bore remains constant, the thickness of the layer of compressible material 216 will again change. After the transition, at point 250 to an even narrower outer diameter, while the diameter of the bore remains constant, the thickness of the layer of compressible material 216 will again change.

In the embodiments shown in FIGS. 3 and 4, an increasingly thinner layer of compressible material 116 or 216 is used in the sections of the gun barrel that are the closest to the muzzle end 124 or 224 or, farthest from the breech end 122 or 222. The layer of compressible material need not be as thick near the muzzle, as the forces in the gun barrel are low at this section of the barrel relative to the breech. Therefore, the gun barrels shown in FIGS. 3 and 4 are lighter than the embodiments shown in FIGS. 1 and 5, if of the same length.

Note as well that in the embodiments shown in both FIGS. 3 and 4, the thickness of the compressible material 16 is greatest nearer the breech end 122 or 222, as the case may be, which is where the greatest explosive forces will be experienced when a projectile is fired from the gun barrel.

The gun barrel 10 of this invention may be assembled by putting sections of pipe together. For example, sections of steel pipe with flanges at each end may be connected together as by bolting, to form the inner layer 14, which defines bore 18. Larger-diameter sections of steel pipe, again with flanges at each end, may be slipped over the inner support layer 12 and connected together for example by bolting. Alternatively, the sections of pipe may be threaded together. Alternatively, or in addition, metal glues may be used to hold the sections of pipe together. In this method of manufacturing the gun barrel, the joints of the inner and outer support layers will not be at the same positions along the finished gun barrel. Reinforcing materials may be placed between the two assembled support layers, followed by addition of the layer of compressible material 16, for example concrete, which would be poured in between the inner and outer support layers. These methods of manufacturing the gun barrel are intended to demonstrate ways that the gun barrel may be made, and are not intended to be limiting.

Figure 6:
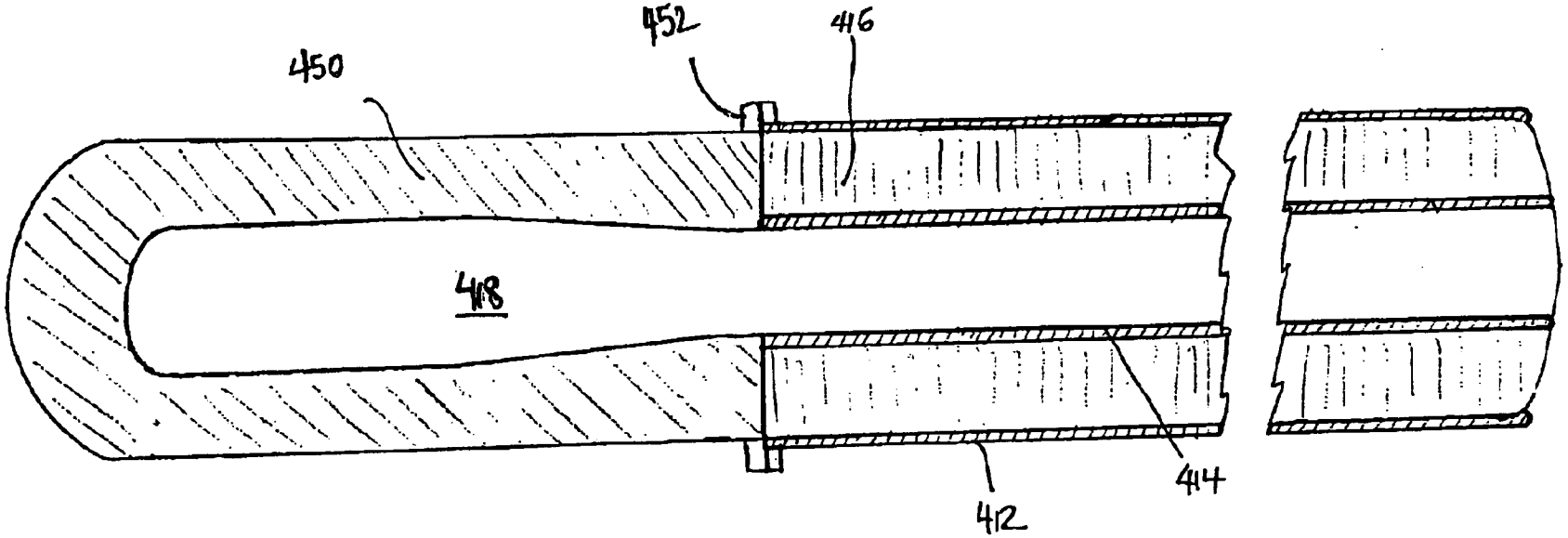
FIG. 6 is a longitudinal cross-sectional view of an embodiment of the gun barrel of this invention showing a breech portion that is entirely comprised of metal.

In an alternative embodiment 410 of the gun barrel, shown in FIG. 6, the breech portion of the gun barrel is made entirely out of a metal, such as steel or titanium. The breech portion 450 is connected as by bolting or threading, to the remainder of the gun barrel, that is made as disclosed above. This hybrid gun barrel 410 shown in FIG. 6, would have a breech portion 450 comprised entirely of metal and the remainder would be comprised of an inner support layer 414, an outer support layer 412 and a layer of compressible material 416 disposed therebetween, and as disclosed above. The breech portion 450 is connected to the rest of the gun barrel by bolts that are threaded through flanges 452. The hybrid gun barrel 410 would have the advantage of having a very strong breech, where the explosive forces from the propellant are the greatest, with the remainder of the gun barrel being relatively inexpensive and lightweight by comparison, but strong enough to withstand the forces generated by the propellant in this part of the gun barrel 410, which is distant from the breech. The breech portion will preferably comprise a portion of the bore 418, as shown in FIG. 6.

While the invention has been described in conjunction with the disclosed embodiments, it will be understood that the invention is not intended to be limited to these embodiments. On the contrary, the invention is intended to cover alternatives, modifications and equivalents, which may be included within the spirit and scope of the invention as defined by the appended claims. In particular, any gun barrel that uses the principle of this invention, which is that of layering a compressible material between two layers of a support material, is intended to be included herein.

Having thus described the gun barrel of this invention, methods of using the gun barrel 10 to launch a rocket comprising a satellite payload will now be disclosed. The gun barrel of this invention will launch a rocket with a satellite payload to a position beyond the lower atmosphere. "Lower atmosphere" as used herein generally refers to the part of the atmosphere in which most weather phenomena occur, (i.e. the troposphere and the stratosphere), and where the majority of the drag on the projectile will occur. Generally, the lower atmosphere will encompass about the first 12 km of the atmosphere above the surface of the earth. Once past the lower atmosphere, the rocket will be fired in two or more additional stages, in order to achieve orbital velocity. The gun barrel of this invention can be used to assist in the launching of satellites into an orbital path that is at an altitude of about 100–300 miles above the earth's surface, generally known in the art as a "low earth orbit". To enter a circular orbit at an altitude of 100 km a velocity of

7.8 km/sec is required and to enter a elliptical orbit a velocity of 10 km/sec is required. In the latter case, orbit will preferably be entered at perigee, as this is the simplest and most fuel-efficient way to enter orbit.

The gun barrel of this invention will launch a projectile, such as a rocket with a satellite and sabot, at a muzzle velocity sufficient to launch the projectile beyond the lower atmosphere. Depending upon a number of parameters, including the weight and shape of the projectile, the length of the gun, the amount of propellant used, the muzzle velocity of a projectile launched from the gun barrel of this invention will be above 1,350 m/sec, and preferably about 1,350 to 3,000 m/sec.

The propellant used to launch the projectile from the gun barrel is preferably be a solid propellant, for example M8M propellant, or a composite propellant. The weight of the projectile is likely to be between about 1,100–1,600 kg, however it can be more or less.

The rocket to be used in the method of this invention may be a conventional rocket that can be obtained for example from military sources. The use of polyurethane foam or a mixture of epoxy and sand protects the electronic components of the rocket and satellite from shock and blast waves.

The shape and design of the projectile that is launched from gun barrel are key factors in the ability of the gun barrel of this invention to assist with the launch of a satellite into orbit. The rocket will preferably have a slender lengthened nose cone to decrease drag, and preferably will use a base bleeder design. The base bleeder design reduces base drag, which is caused by a vacuum or suction effect at the base of the projectile. If the rocket is fired from a smooth bore gun barrel, the rocket will likely be fin stabilized. However, other means of stabilizing the rocket during flight are intended to be included herein.

Preferred in the methods of this invention is a rocket that uses liquid, rather than solid propellant. Solid propellants in a rocket cannot generally withstand the blast forces of the launch from the gun barrel, although plastic solid rocket fuels may be able to do so. If the fuel cell in the rocket is completely full of liquid propellant, the fuel cell will be able to withstand the G-forces of launch. Additionally, fuel cells for liquid propellants can have thinner walls than can fuel cells for solid propellants, making the entire rocket lighter. Solid fuels may also be used in the rocket, and provide the advantage of being able to be activated by a time-delayed fuse, such as a squib.

Liquid fuels provide about 2-times the thrust of solid fuels, liquid fuels can be throttled, and they have a superior specific impulse. The latter is defined as the thrust developed by burning one pound of fuel in one second, and therefore specific impulse is the inverse of fuel efficiency. By using a more efficient fuel, the rocket is lighter. A preferred liquid fuel for the methods of this invention is kerosene, although other fuels may be used. A liquid fuel is used with an oxidant. Preferred as an oxidant is hydrogen peroxide, although liquid oxygen may be used as well.

Particularly preferred in the methods of this invention is a rocket that uses hydrogen peroxide as propellant, kerosene as oxidant, and which has a specific impulse of at least 200. A specific impulse of over 200 is required to achieve orbital velocity. This rocket is able to carry more propellant for its size than other rockets. This rocket can be obtained commercially, or can be manufactured from stainless steel by a skilled machinist The methods of this invention include the use of a sabot, which as used herein means a device fitted around or in back of the rocket in a gun barrel. The sabot may be made of any of a number of materials, including metal and wood. The sabot performs one or more of a variety of functions including: supporting the projectile, protecting the projectile, preventing the escape of gas ahead of the sabot, and increasing the life-span of the gun barrel. The use of a sabot increases the muzzle velocity and range of the rocket. Also, as a sabot can be positioned around the rocket, the diameter of the bore that can be used is increased, with a corresponding increase in the amount of propellant that can be used in the barrel. The sabot separates from the rocket, after launching, and in this regard, a sabot stripper may be added at or near the muzzle of the gun barrel to aid in the removal of the sabot upon exit of the projectile from the barrel.

The muzzle end 24 of the gun barrel 10 may have a cap placed over its opening, said cap popping off of the muzzle end just before the projectile reaches the muzzle. The cap causes a vacuum to be created in the gun barrel, which vacuum permits the projectile to travel significantly further than without it.

To decrease the amount of air resistance (drag) experienced by the projectile after launch, the gun barrel may be positioned at a high altitude, for example on the top of a mountain. If positioned at a 45-degree angle before launching the projectile, for example by resting it on the side of a hill, and launched eastward, the rocket will be boosted by the earth's rotation.

The following examples are intended only to illustrate and describe the invention rather than limit the claims that follow.

EXAMPLES

Example 1

To fire a projectile, such as a rocket with sabot, that is a total weight of about 10.5 kg; a gun barrel of about 9.1 meters in length can be used. The gun barrel would have a constant outer diameter of about 25 cm. The inner bore would comprise two sections with different diameters, a wide-diameter section and a narrow-diameter section. The wide-diameter section, closer to the breech end, would be about 0.9 meters in length, and would have a constant diameter of about 15 cm. The narrow-diameter section, nearer the muzzle end, would be about 7.9 meters in length, and would have a constant diameter of about 13 cm. A 30.5 cm long transition section, of varying diameter, would connect these two sections of the bore.

The outer layer would be comprised of 12.5 mm thick, A105 steel, and the inner layer would be made of 12.5 mm thick, A105 steel. The concrete layer formed between the two steel layers would be concrete with a compressive strength of 80 mPa, reinforced with #10 rebar. The thickness of the concrete layer varies from breech to muzzle, as the inner bore is wider closer to the breech end and narrower closer to the muzzle end, whereas the outer diameter of the gun barrel remains constant. Around the wide-diameter section of the bore, the concrete layer would be about 2.5 cm wide, whereas around the narrow-diameter section of the bore, the concrete layer would be about 3.8 cm wide.

This gun barrel is calculated to be stable to a maximum breech pressure of about 80,000 psi, but would be used at a working pressure of about 50,000 psi. The projectile would be discharged with 50 pounds of M8M propellant, resulting in a muzzle velocity of about 1,650 m/sec.

Example 2

To fire a projectile that is a total weight of about 2,500 kg including the rocket, satellite and sabot beyond the lower atmosphere, a gun barrel of about 98 meters in length can be constructed. The gun barrel would have two sections, each with a different outer diameter, referred to as wide- and narrow-diameter sections. The wide-diameter section, nearer to the breech end, would have a constant diameter of about 1550 mm, and the narrow-diameter section, nearer the muzzle end, would have a constant diameter of about 1100 mm. The wide-diameter section would be a total of about 7 meters in length, whereas the narrow-diameter section would be a total of about 92 meters in length.

The bore would comprise three sections each with different diameters, namely, wide-, mid- and narrow-diameter section. The wide-diameter section, nearer the breech end, would be about three meters in length, and would have a constant diameter of about 1000 mm. The mid-diameter section, next closest to the muzzle end, would be about two meters in length, and would have a constant diameter of about 900 mm. The narrow-diameter section, closest to the muzzle end, would be about 91 meters in length, and would have a constant diameter of about 800 mm. 30.5 cm long transition sections would connect sections of the bore that vary in diameter.

The outer support layer would be comprised of 12.5 mm thick, A105 steel, and the inner support layer would have a smooth bore and be comprised of 12.5 mm thick, A105 steel. The first 20 meters of the inner bore would be comprised of hardened steel.

The concrete layer formed between the two steel layers is made from concrete with a compressive strength of 80 mPa and reinforced with #10 rebar. The thickness of the concrete layer varies proceeding from breech towards muzzle, within the first 7 meters of the barrel. Around the wide-diameter section of the bore, the concrete layer is about 250 mm thick; around the mid-diameter section of the bore, the concrete layer is about 300 mm thick, and around the narrow diameter section of the bore, the concrete layer is about 350 mm thick.

After the first 7 meters, the outer diameter of the gun barrel decreases to 1100 mm and therefore the thickness of the concrete layer decreases to about 125 mm.

The gun barrel would comprise a sabot stripper that removes the sabot uniformly and does not effect projectile stability in flight. Additionally, a vacuum cap on the gun barrel will increase range.

The projectile to be fired would have a diameter of about 800 mm and a length of about 9 meters.

This gun barrel is calculated to be stable to a maximum breech pressure of about 95,000 psi, but would be used at a working pressure of about 65,000 psi. The projectile would be discharged with M8M propellant, resulting in a muzzle velocity of about 2,100 m/sec.

Example 3

To fire a projectile that is a total weight of about 2,500 kg, including the rocket, satellite and sabot, beyond the lower atmosphere, a gun barrel of about 125 meters in length can be constructed. The gun barrel would have sections with one of three different outer diameters, referred to as wide- mid- and narrow-diameter sections. The wide-diameter section, nearer to the breech end, would have a constant outer diameter of about 1550 mm, the mid-diameter section would have a constant outer diameter of about 1100 mm and the narrow-diameter section would have a constant outer diameter of about 900 mm. The wide-diameter section would be a total of about 22 meters in length, the mid-diameter section would be a total of about 12 meters in length, and the narrow-diameter section would be a total of about 91 meters in length.

The bore would comprise three sections each with different diameters, namely, wide-, mid- and narrow-diameter section. The wide-diameter section, nearer the breech end, would be about 10 meters in length, and would have a constant diameter of about 1000 mm. The mid-diameter section, next closest to the muzzle end, would be about 10 meters in length, and would have a constant diameter of about 900 mm. The narrow-diameter section, closest to the muzzle end, would be about 91 meters in length, and would have a constant diameter of about 800 mm. A one meter long transition section, of varying diameter, would connect two sections of the bore that are different in diameter.

The outer support layer would be comprised of 12.5 mm thick, A105 steel, and the inner support layer would have a smooth bore and be comprised of 12.5 mm thick, A105 steel. The first 25 meters of the bore will be comprised of hardened steel.

The concrete layer between the two steel layers is made from concrete with a compressive strength of 80 mPa and reinforced with #10 rebar. The thickness of the concrete layer varies proceeding from breech towards muzzle. Within the first 22 meters of the barrel, around the wide-diameter section of the bore, the concrete layer is about 250 mm thick; around the mid-diameter section of the bore, the concrete layer is about 300 mm thick, and around the narrow diameter section of the bore, the concrete layer is about 350 mm thick. After the first 22 meters, the outer diameter of the gun barrel decreases to 1100 mm, and therefore the thickness of the concrete layer decreases to about 125 mm. After the next 12 meters, proceeding towards the muzzle end, the outer diameter of the gun barrel decreases to 900 mm and the thickness of the concrete layer is about 25 mm.

The gun barrel would comprise a sabot stripper that removes the sabot uniformly and does not effect projectile stability in flight. Additionally, a vacuum cap on the gun barrel will increase range.

The projectile to be fired would have a diameter of about 800 mm and a length of about nine meters.

This gun barrel is calculated to be stable to a maximum breech pressure of about 95,000 psi, but would be used at a working pressure of about 60,000 psi. The projectile would be discharged with M8M propellant, resulting in a muzzle velocity of about 2,100 m/sec.

Example 4

This gun barrel can be used to launch a projectile with a weight of about 1,100 kg and a length of about 9 meters. The projectile to be launched would have a diameter of about 800 mm, 400 mm of that diameter comprising the rocket, and 400 mm of that diameter comprising the sabot that surrounds the rocket. The sabot functions to protect the rocket, to increase the muzzle velocity and to increase the life of the gun. The projectile will be fin stabilized.

The gun barrel would be a total of about 77 meters in length, with the first 32 meters of the bore lined with hardened steel to increase the life of the gun. The bore would have a constant diameter of 800 mm, the concrete layer would have a thickness of about 260 mm, and the inner and outer support layers would be made of 12.5 mm thick, A105 steel. Therefore, the outer diameter of the gun barrel would be about 1370 mm. The concrete layer formed between the two steel layers is made from concrete with a compressive strength of 80 mPa and reinforced with #10 rebar.

The gun barrel would comprise a sabot stripper that removes the sabot uniformly and does not effect projectile stability in flight. Additionally, a vacuum cap on the gun barrel will increase range. Explosives lined up in front of the gun, and detonated just prior to the projectile leaving the gun will create a vacuum that may decrease drag.

The gun barrel would be positioned at a 45-degree angle before launching the projectile, for example by resting it on the side of a hill. The propelling charge would be 600 kg of M8M propellant. It is anticipated that the muzzle velocity of the projectile would be approximately 1,500 m/sec, which would be sufficient to launch the projectile past the first 12 km of the atmosphere.

What is claimed is:

1. A gun barrel with a breech end and an open end and a bore disposed between the breech end the open end, comprising:

(a) a breech portion made of metal, and (b) an elongate portion adjacent to the breech portion, said elongate potion further comprising:

(i) an outer support layer on an outside surface;

(ii) an inner support layer lining the bore of the aun barrel, and (iii) a layer of concrete disposed between the outer support layer and inner support layer, said concrete having a compressive strength of at least 10 megapascals and having a compressive strength that is less than the compressive strength of one of (a) the inner support layer or (b) the outer support layer.

2. The gun barrel of claim 1 wherein the outer support layer is comprised of a metal.

3. The gun barrel of claim 2 wherein the outer support layer is comprised of steel.

4. The gun barrel of claim 2 wherein the inner support layer is comprised of a metal.

5. The gun barrel of claim 4 wherein the inner support layer and the outer support layer are comprised of steel.

6. The gun barrel of claim 1 wherein the inner support layer is comprised of a metal.

7. The gun barrel of claim 6 wherein the inner support layer is comprised of steel.

8. The gun barrel of claim 1 wherein the concrete has a compressive strength of at least 80 megapascals.

9. The gun barrel of claim 8 additionally comprising a reinforcing element disposed in the concrete.

10. The gun barrel of claim 9 wherein the breech portion is made of steel or titanium.

11. The gun barrel of claim 8 wherein the bore is larger in diameter at the breech end than at the open end.

12. The gun barrel of claim 8 wherein the breech portion is made of steel or titanium.

13. The gun barrel of claim 1 additionally comprising a reinforcing element disposed in the concrete.

14. The gun barrel of claim 1 wherein the bore is larger in diameter at the breech end than at the open end.

15. The gun barrel of claim 1 wherein the breech portion is made of steel or titanium.

16. The gun barrel of claim 1 wherein the breech end is closed.

17. The gun barrel of claim 1 wherein the breech end is closeable.

18. The gun barrel of claim 17 wherein the breech end is closeable with a breech plug.

19. A gun barrel with a breech end and an open end and a bore disposed between the breech end open end, comprising:

(a) a breech portion made of metal, and (b) an elongate portion adjacent to the breech portion, said elongate portion further comprising:

(iv) an outer support layer comprised of steel, on an outside surface;

(v) an inner support layer comprised of steel, lining the bore of the gun barrel, and (vi) a layer of concrete disposed between the outer support layer and inner support layer, said concrete having a compressive strength of at least 10 megapascals and having a compressive strength that is less than the compressive strength of one of (a) the inner support layer or (b) the outer support layer.

20. The gun barrel of claim 19 wherein the concrete has a compressive strength of at least 80 megapascals.

21. The gun barrel of claim 20 additionally comprising a reinforcing element disposed in the concrete.

22. The gun barrel of claim 21 wherein the breech portion is made of steel or titanium.

23. The gun barrel of claim 20 wherein the bore is larger in diameter at the breech end than at the open end.

24. The gun barrel of claim 19 additionally comprising a reinforcing element disposed in the concrete.

25. The gun barrel of claim 24 wherein the breech portion is made of steel or titanium.

26. The gun barrel of claim 19 wherein the breech end is closed.

27. The gun barrel of claim 19 wherein the breech end is closeable.

28. The gun barrel of claim 27 wherein the breech end is closeable with a breech plug.

29. The gun barrel of claim 19 wherein the bore is larger in diameter at the breech end than at the open end.

30. The gun barrel of claim 19 wherein the breech portion is made of steel or titanium.

* * * * *

UNITED STATES PATENT AND TRADEMARK OFFICE

CERTIFICATE OF CORRECTION

PATENT NO. : 6,789,454 B2
DATED : September 14, 2004
INVENTOR(S) : Smith, Rixford It is certified that error appears in the above-identified patent and that said Letters Patent is hereby corrected as shown below:

Column 13,
Line 13, insert the word -- and -- between the term “the breech end” and the term “the open end”;
Line 17, the word “potion” reads -- portion --;
Line 19, the word “aun” reads -- gun --.

Column 14,
Line 12, insert the word -- and -- between the term “the breech end” and the term “the open end”
Lines 17, 19 and 21, parts “(iv)”, “(v)” and “(vi)” and numbered -- (i) --, -- (ii) -- and -- (iii) --, respectively.

Signed and Sealed this

Eighth Day of March, 2005

JON W. DUDAS
*Director of the United States Patent and Trademark Office*